US011285597B2

(12) United States Patent
Hsieh

(10) Patent No.: US 11,285,597 B2
(45) Date of Patent: Mar. 29, 2022

(54) PNEUMATIC TOOL STRUCTURE CAPABLE OF ISOLATING SHOCK AND RELEASING PRESSURE

(71) Applicants: Chih-Kuan Hsieh, Hemei Township, Changhua County (TW); Ya-Chun Lai, Taoyuan (TW)

(72) Inventor: Chih-Kuan Hsieh, Hemei Township (TW)

(73) Assignees: Chih-Kuan Hsieh, Hemei Township (TW); Ya-Chun Lai, Taoyuan (TW)

( * ) Notice: Subject to any disclaimer, the term of this patent is extended or adjusted under 35 U.S.C. 154(b) by 0 days.

(21) Appl. No.: 16/906,197

(22) Filed: Jun. 19, 2020

(65) Prior Publication Data

US 2021/0394352 A1 Dec. 23, 2021

(51) Int. Cl.

| | |
|---|---|
| ***B25F 5/02*** | (2006.01) |
| ***B25F 5/00*** | (2006.01) |
| ***B08B 7/02*** | (2006.01) |
| ***B25D 9/06*** | (2006.01) |
| ***B21C 43/00*** | (2006.01) |

(52) U.S. Cl.

CPC ..... *B25F 5/006* (2013.01); *B08B 7/022* (2013.01); *B21C 43/00* (2013.01); *B25D 9/06* (2013.01); *B25D 2217/0015* (2013.01)

(58) Field of Classification Search

CPC ... B25F 5/006; B25D 9/06; B25D 2217/0015; B08B 7/022; B21C 43/00

See application file for complete search history.

(56) References Cited

U.S. PATENT DOCUMENTS

| | | | | | |
|---|---|---|---|---|---|
| 4,134,193 | A * | 1/1979 | Lenzin | B08B 7/022 | 29/81.14 |
| 4,632,190 | A * | 12/1986 | Mikiya | B25D 9/14 | 173/133 |
| 5,010,632 | A * | 4/1991 | Gardner | B08B 7/022 | 29/81.01 |
| 5,251,367 | A * | 10/1993 | Ward | B25D 17/02 | 173/168 |
| 5,775,981 | A * | 7/1998 | Yang | B24B 23/02 | 451/295 |
| 6,668,942 | B1 * | 12/2003 | Lin | B25D 17/24 | 173/162.1 |

(Continued)

*Primary Examiner* — Hemant Desai
*Assistant Examiner* — Mobeen Ahmed
(74) *Attorney, Agent, or Firm* — Karin L. Williams; Alan D. Kamrath; Mayer & Williams PC

(57) ABSTRACT

A pneumatic tool structure contains an air intake head, a slidable sleeve, a drive unit, a piston, an operation element, a resilient element, a first isolation ring, and a second isolation ring. The air intake head includes a press lever, an air channel, and a connection portion. The connection portion has a first coupling orifice. The slidable sleeve includes a shoulder. The drive unit includes a body, a recessed portion having a defining fringe, a screw bolt, and a chamber. An air discharge conduit is defined between the slidable sleeve and the body. The first segment has a second coupling orifice. The resilient element includes a through hole. The first isolation ring includes a first rim, a second rim, multiple first discharging grooves, and multiple first contact portions. The second isolation ring includes a third rim, a fourth rim, multiple second discharging grooves, and multiple second contact portions.

5 Claims, 20 Drawing Sheets

(56) References Cited

U.S. PATENT DOCUMENTS

| | | | | |
|---|---|---|---|---|
| 2002/0162421 | A1* | 11/2002 | Galat | B25F 5/006 81/57.13 |
| 2005/0263308 | A1* | 12/2005 | Chang | B25D 17/24 173/210 |
| 2007/0215370 | A1* | 9/2007 | Chen | B25D 17/24 173/162.1 |
| 2008/0006424 | A1* | 1/2008 | Honsa | B25F 5/006 173/162.1 |
| 2009/0065231 | A1* | 3/2009 | Lu | B25D 17/24 173/211 |
| 2010/0139940 | A1* | 6/2010 | Kobayashi | B25D 17/24 173/162.2 |
| 2011/0263185 | A1* | 10/2011 | Nelson | B24B 41/007 451/358 |
| 2012/0097410 | A1* | 4/2012 | Honsa | B25D 17/24 173/162.2 |
| 2014/0299345 | A1* | 10/2014 | McRoberts | B25F 5/006 173/162.2 |
| 2016/0271780 | A1* | 9/2016 | Lin | B25D 17/24 |
| 2018/0133862 | A1* | 5/2018 | Davis | B25F 3/00 |
| 2018/0222032 | A1* | 8/2018 | Cheng | B08B 7/022 |
| 2021/0033176 | A1* | 2/2021 | Chen | F16H 35/10 |
| 2021/0053201 | A1* | 2/2021 | Mandal | B25B 21/02 |

* cited by examiner

PNEUMATIC TOOL STRUCTURE CAPABLE OF ISOLATING SHOCK AND RELEASING PRESSURE

BACKGROUND OF THE INVENTION

Field of the Invention

The present invention relates to a pneumatic tool structure, and more particularly to the pneumatic tool structure which is capable of isolating shock and releasing pressure.

Description of the Prior Art

A conventional pneumatic tool operates in a reciprocating manner or in a rotating manner, wherein when the conventional pneumatic tool operates in the reciprocate manner, a piston is pushed by high-pressure airs to strike an operation element reciprocately, and the operation element is driven to move reciprocately, thus removing rusts, cutting, punching, and chiseling.

With reference to FIGS. 12 and 13, a conventional pneumatic tool 90 includes a body 91, a transmission element 92, a connection unit 93, and an operation element 94, wherein the body 91 includes an air intake head 911 on which a switch 912 is arranged, and the intake head 911 is connected with a tube 913, wherein the tube 913 has a fixing orifice 9131 defined on a center thereof away from the intake head 911, a connecting groove 9132 formed on an outer wall of the tube 913, a cutout 9133 defined on the connecting groove 9132 and communicating with the fixing orifice 9131, and a chamber 9134 formed in the tube 913 and communicating with the fixing orifice 9131. The chamber 9134 further has an air valve 914 adjacent to the intake head 911, and a piston 915 accommodated between the air valve 914 and the fixing orifice 9131. The transmission element 92 includes a rod 921 and a disk-shaped abutting portion 922, and the connection unit 93 has two protrusions 931 and a positioning ring 932, wherein the rod 921 of the transmission element 92 is inserted in the fixing orifice 9131 of the tube 913, the two protrusions 931 of the connection unit 93 are received in the cutout 9133 of the tube 913, and the positioning ring 932 of the connection unit 93 is engaged in the connecting groove 9132 of the tube 913 so that the transmission element 92 is positioned in an end of the tube 913 of the body 91 away from the intake head 911. The operation element 94 has a tool socket 941 fitted on an outer wall of the tube 913, the tool socket 941 accommodates a resilient element 942, a holder 943, multiple rust removal needles 944 inserted on the holder 943 and extending out of the tool socket 941, wherein the holder 943 abuts against a push portion 922 of the transmission element 92.

In operation, the intake head 911 and the tube 913 are griped with a hand, and the tool socket 941 is held with the other hand, then the switch 912 is turned on so that the high-pressure airs flow to push the piston 915 to slidably strike the transmission element 92 via the air valve 914, and the high-pressure airs pushes the piston 915 to strike the air valve 914 after shifting the air valve 914, such that the piston 915 moves back and forth reciprocately to strike the transmission element 92 and the air valve 914, the push portion 922 of the transmission element 92 pushes the holder 943 of the operation element 94 to actuate the multiple rust removal needles 944 to remove rusts.

However, when the piston 915 of the conventional pneumatic tool strikes the air valve 914, vibration produces from reaction force and transmits to a user's hand holding the intake head 911 and the tube 913, thus causing operating discomfort, reducing work efficiency, sore hands and injured wrists (because the user has to hold the intake head 911 and the tube 913).

The present invention has arisen to mitigate and/or obviate the afore-described disadvantages.

SUMMARY OF THE INVENTION

The primary object of the present invention is to provide a pneumatic tool structure by which when a piston slides backward to strike an air valve, an air guide tube is configured to guide a body, a resilient element is pressed to buffer a strike, and a first isolation ring and a second isolation ring isolate a shock, thus reducing a vibration effectively.

Another object of the present invention is to provide a pneumatic tool structure which contains an air discharge conduit defined between a slidable sleeve and the body, multiple first discharging grooves equidistantly formed on an outer wall of the first isolation ring, and multiple second discharging grooves equidistantly formed on an outer wall of the second isolation ring, a defining fringe of the body having at least one pressure relief groove, thus releasing a pressure to operate the pneumatic tool structure normally.

To provide above-mentioned objects, a pneumatic tool structure provided by the present invention contains an air intake head, a slidable sleeve, a drive unit, a piston, an operation element, a resilient element, a first isolation ring, and a second isolation ring.

The air intake head includes a press lever, an air channel, and a connection portion formed on an end of the air intake head. The connection portion has a first coupling orifice defined on an edge of the connection portion and communicating with the air channel and configured to accommodate an end of an air guide tube.

A first end of the slidable sleeve is screwed with the connection portion of the air intake head, and the slidable sleeve includes a shoulder extending from an inner wall of a second end of the slidable sleeve.

The drive unit includes a body having a first segment and a second segment, a part of the second segment of the body is slidably fitted in the slidable sleeve, and the body includes a recessed portion formed around an outer wall of the body. The recessed portion has a defining fringe formed on an end of the recessed portion adjacent to the air intake head and stopped by the shoulder of the slidable sleeve, such that the body is limited to slide forward in an extreme position. An air discharge conduit is defined between the slidable sleeve and the body, the defining fringe has at least one pressure relief groove, the body has a screw bolt disposed in the second segment of the body, and the screw bolt has an air flow orifice formed on a center thereof and configured to accommodate the air guide tube. The first segment of the body has a second coupling orifice, the body has a chamber communicating with the second coupling orifice, and an air valve is mounted between the chamber and the screw bolt.

The piston slidably is accommodated in the chamber.

The operation element is fixed on a front side of the body

The resilient element is elastic, received in the slidable sleeve, and defined between the air intake head and the screw bolt. The resilient element includes a through hole for receiving the air guide tube.

A first isolation ring is fitted on an outer wall of the screw bolt and is located between the screw bolt and the slidable sleeve. The first isolation ring includes a first rim, a second rim opposite to the first rim, multiple first discharging grooves equidistantly formed on an outer wall of the first isolation ring, and multiple first contact portions. A respective first contact portion is formed between any two adjacent first discharging grooves, and the multiple first discharging grooves are in communication with the first rim and the second rim.

A second isolation ring is fitted on the outer wall of the body and is located between the body and the slidable sleeve, the second isolation ring includes a third rim, a fourth rim opposite to the third rim, multiple second discharging grooves equidistantly formed on an outer wall of the second isolation ring, and multiple second contact portions. A respective second contact portion is formed between any two adjacent second discharging grooves, and the multiple second discharging grooves are in communication with the third rim and the fourth rim.

DETAILED DESCRIPTION OF THE PREFERRED EMBODIMENTS

Figure 1:
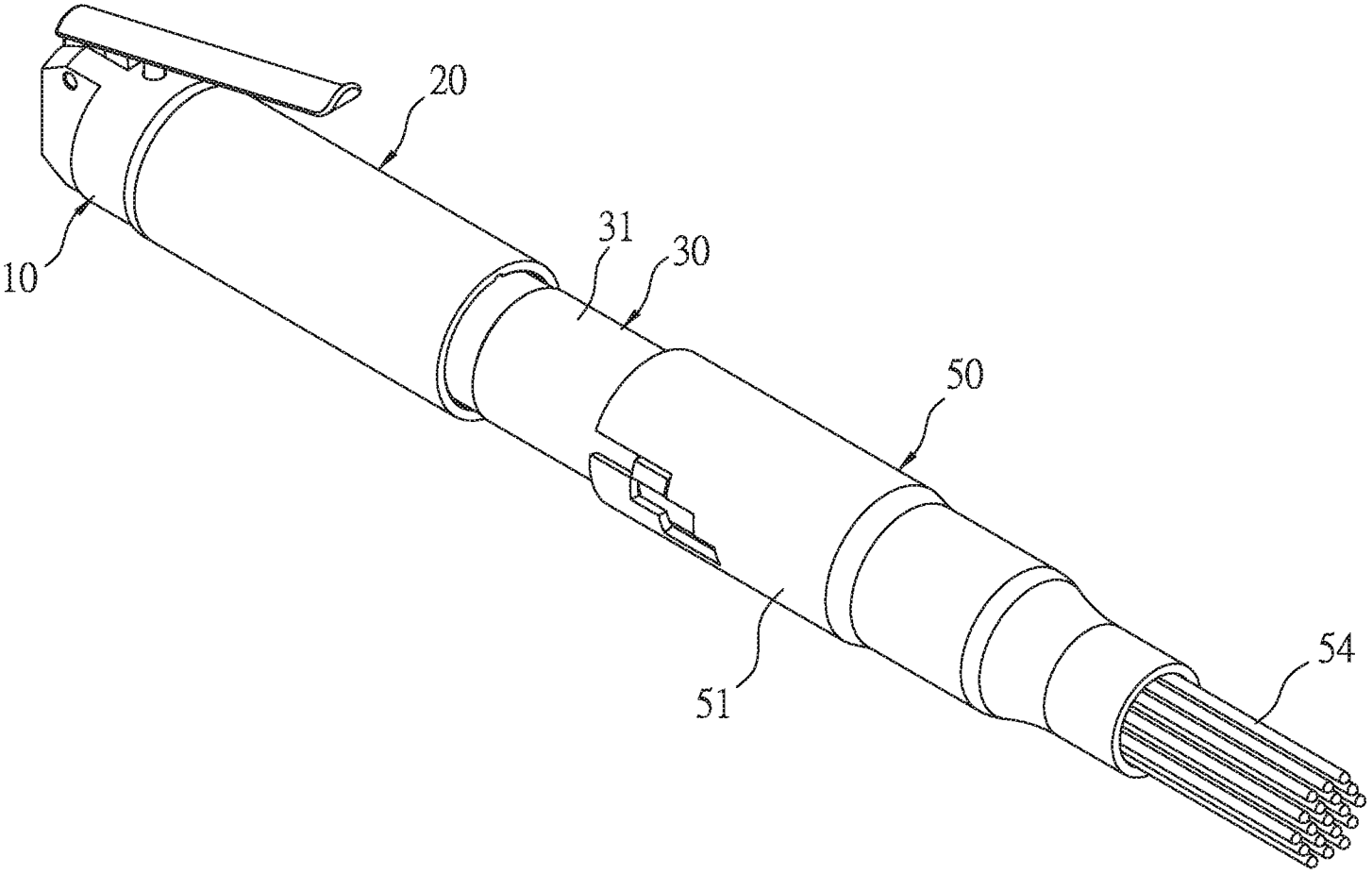
FIG. 1 is a perspective view showing the assembly of a pneumatic tool structure according to a preferred embodiment of the present invention.
Figure 2:
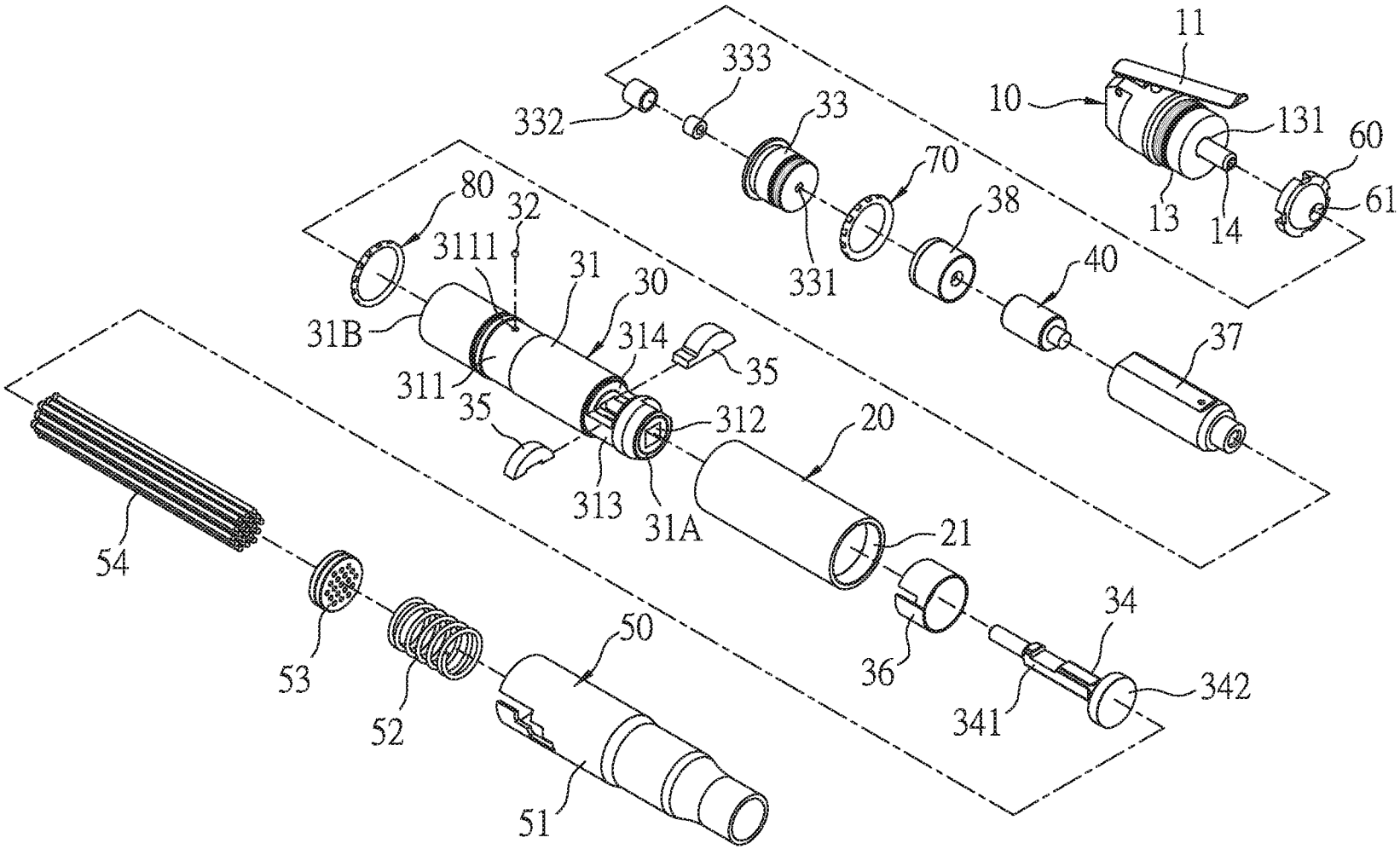
FIG. 2 is a perspective view showing the exploded components of the pneumatic tool structure according to the preferred embodiment of the present invention.
Figure 3A:
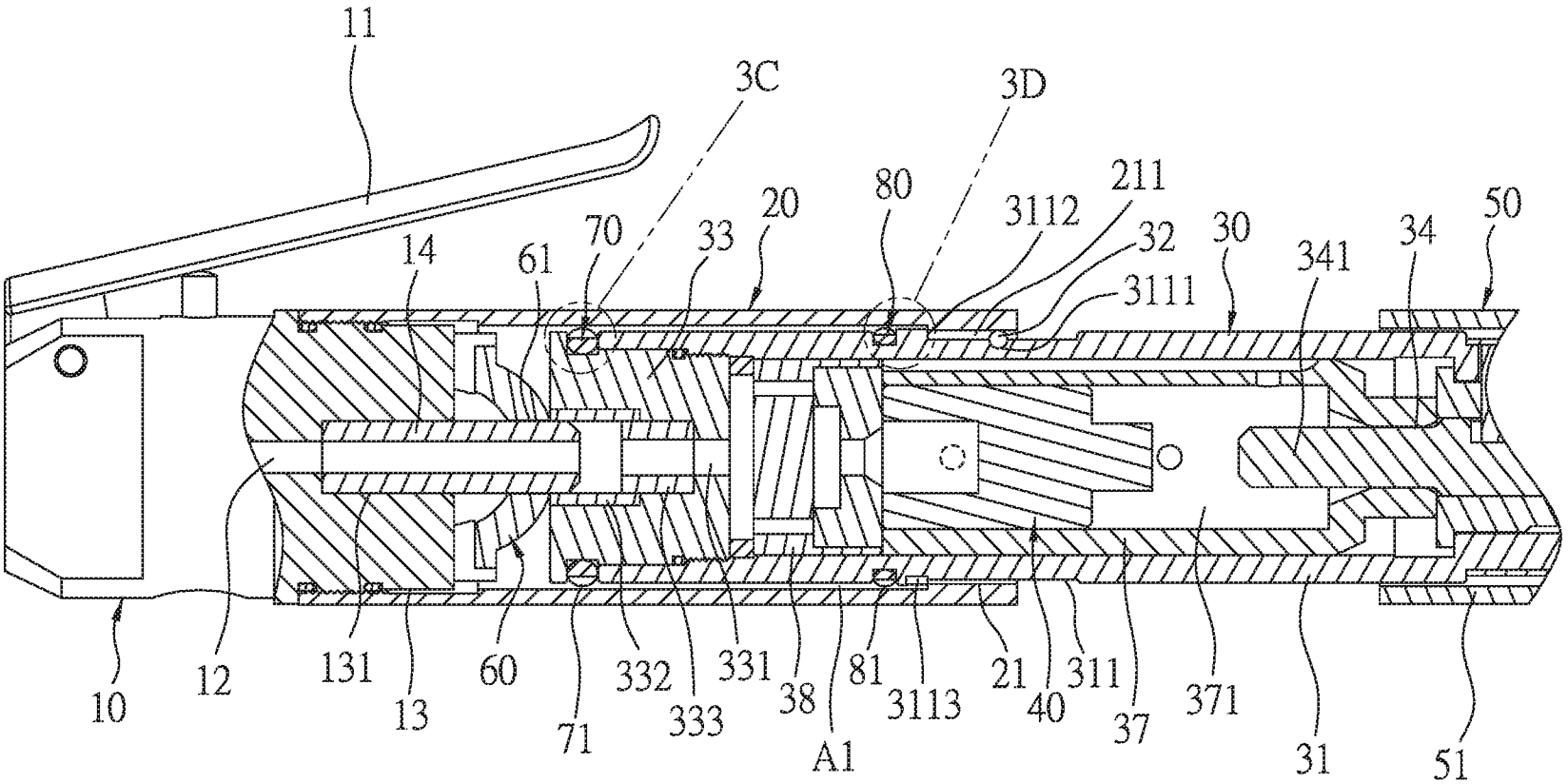
FIG. 3A is a cross sectional view showing the assembly of a part of the pneumatic tool structure according to the preferred embodiment of the present invention.
Figure 3B:
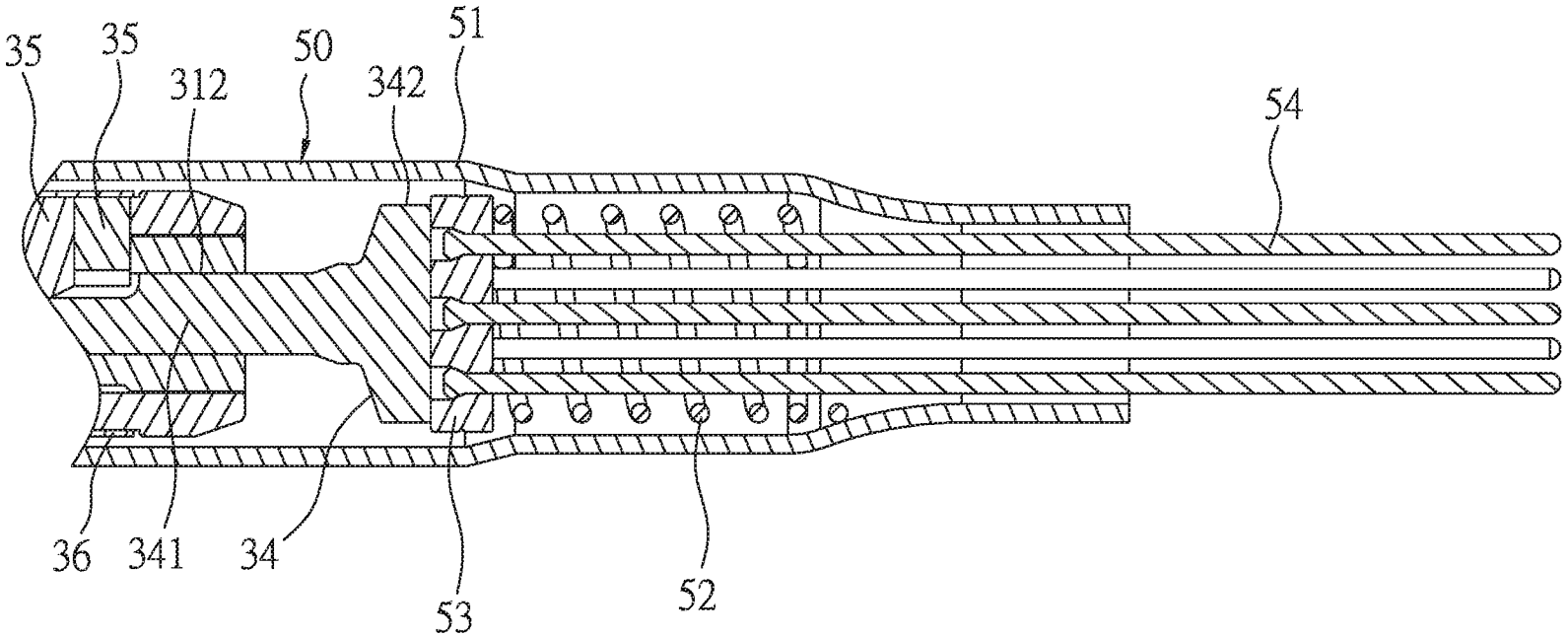
FIG. 3B is another cross sectional view showing the assembly of a part of the pneumatic tool structure according to the preferred embodiment of the present invention.
Figure 3C:
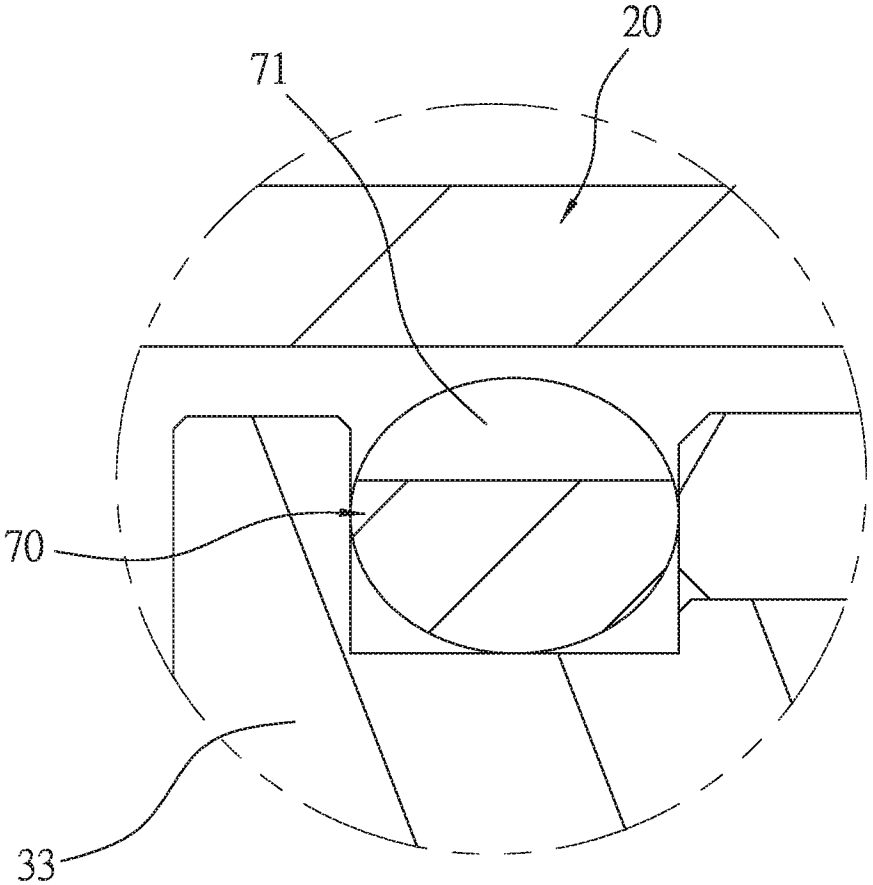
FIG. 3C is an amplified cross sectional view of a portion 3C of FIG. 3A.
Figure 3D:
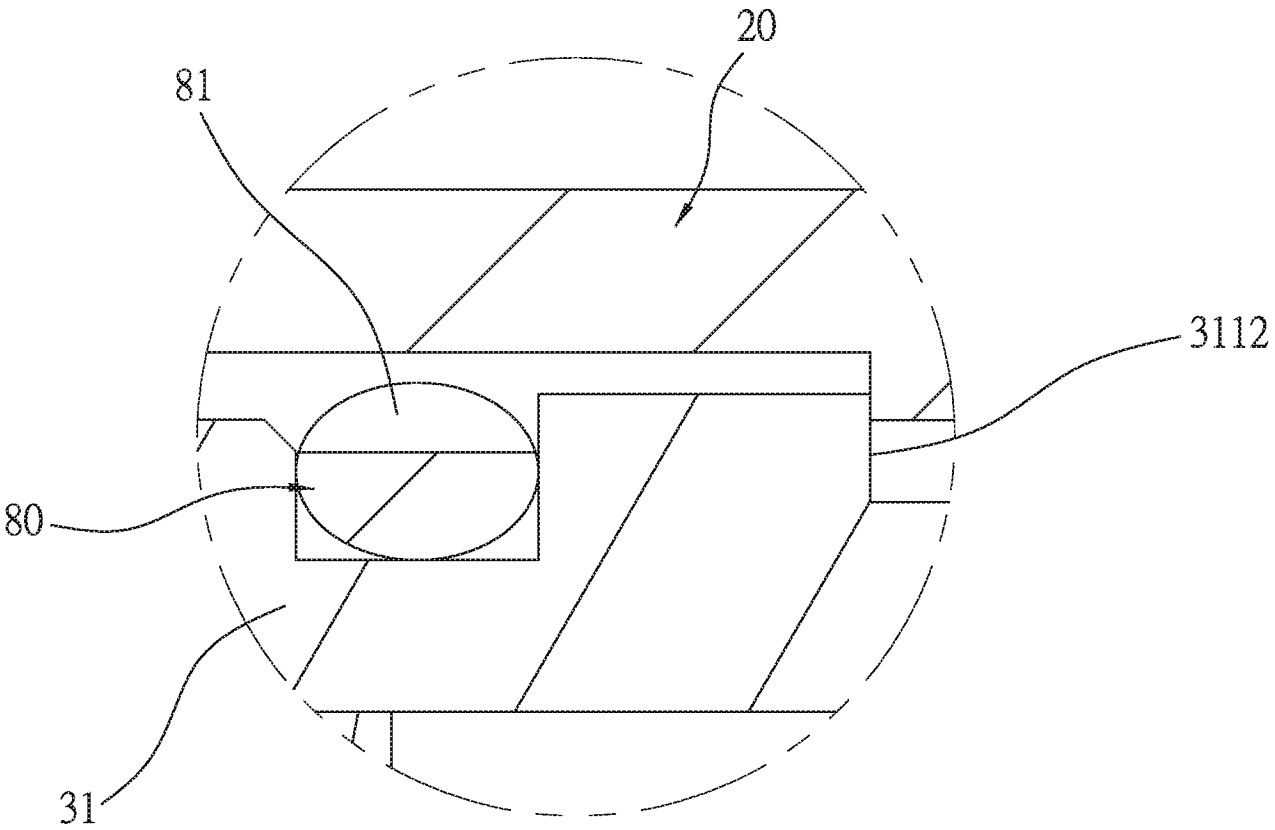
FIG. 3D is an amplified cross sectional view showing another portion 3D of FIG. 3A.

The present invention will be clearer from the following description when viewed together with the accompanying drawings, which show, for purpose of illustrations only, a preferred embodiment in accordance with the present invention.

With reference to FIGS. 1-3D, a pneumatic tool structure according to a preferred embodiment of the present invention comprises an air intake head 10, a slidable sleeve 20, a drive unit 30, a piston 40, an operation element 50, a resilient element 60, a first isolation ring 70, and a second isolation ring 80.

The air intake head 10 includes a press lever 11, an air channel 12, and a connection portion 13 formed on an end of the air intake head 10, the connection portion 13 has a first coupling orifice 131 defined on an edge thereof and communicating with the air channel 12 and configured to accommodate an end of an air guide tube 14.

Figure 4:
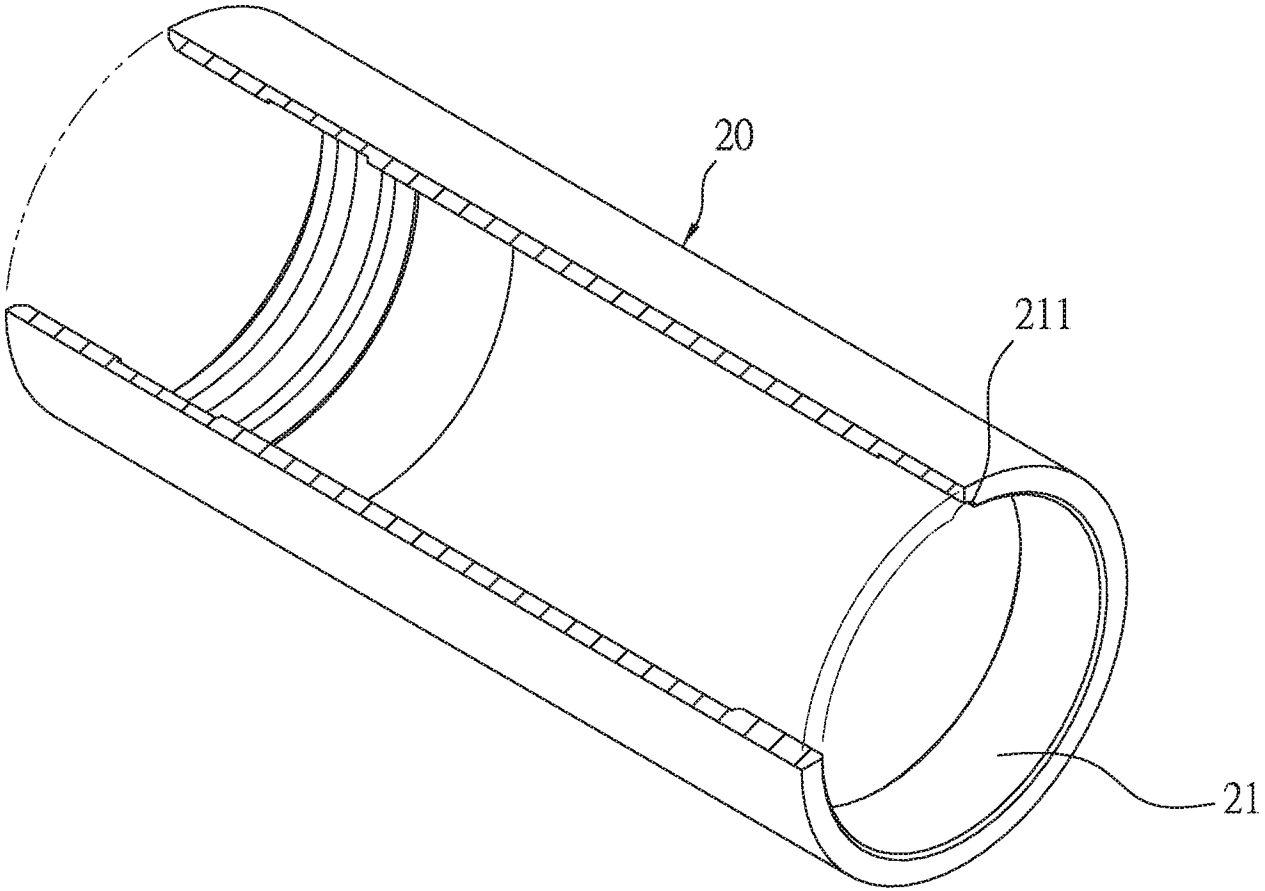
FIG. 4 is a cross sectional perspective view showing a part of the pneumatic tool structure according to the preferred embodiment of the present invention.

Referring to FIG. 4, a first end of the slidable sleeve 20 is screwed with the connection portion 13 of the air intake head 10, the slidable sleeve 20 includes a shoulder 21 extending from an inner wall of a second end thereof, and the shoulder 21 has an elongated slot 211 formed thereon.

Figure 5:
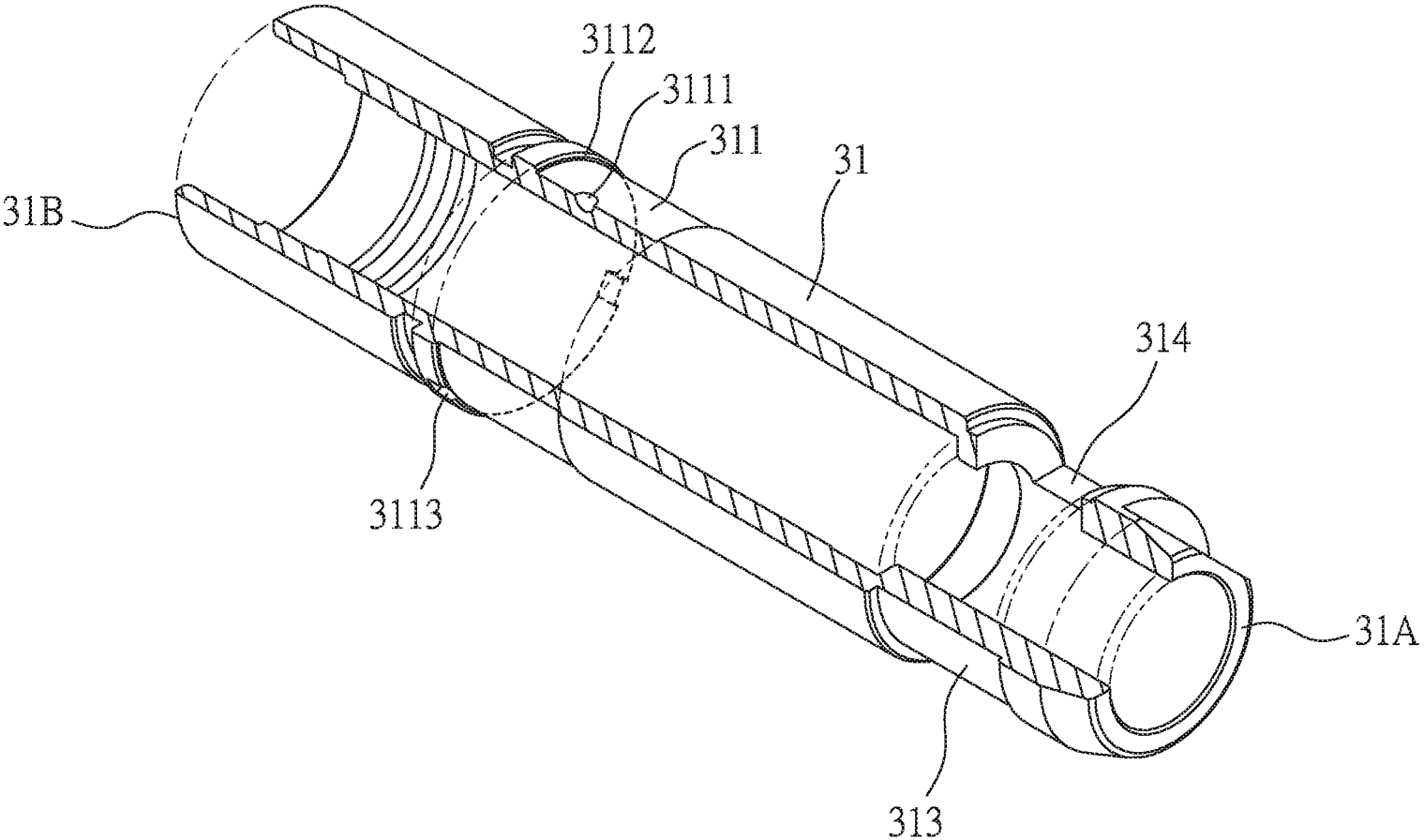
FIG. 5 is a cross sectional perspective view showing a part of the pneumatic tool structure according to the preferred embodiment of the present invention.
Figure 6:
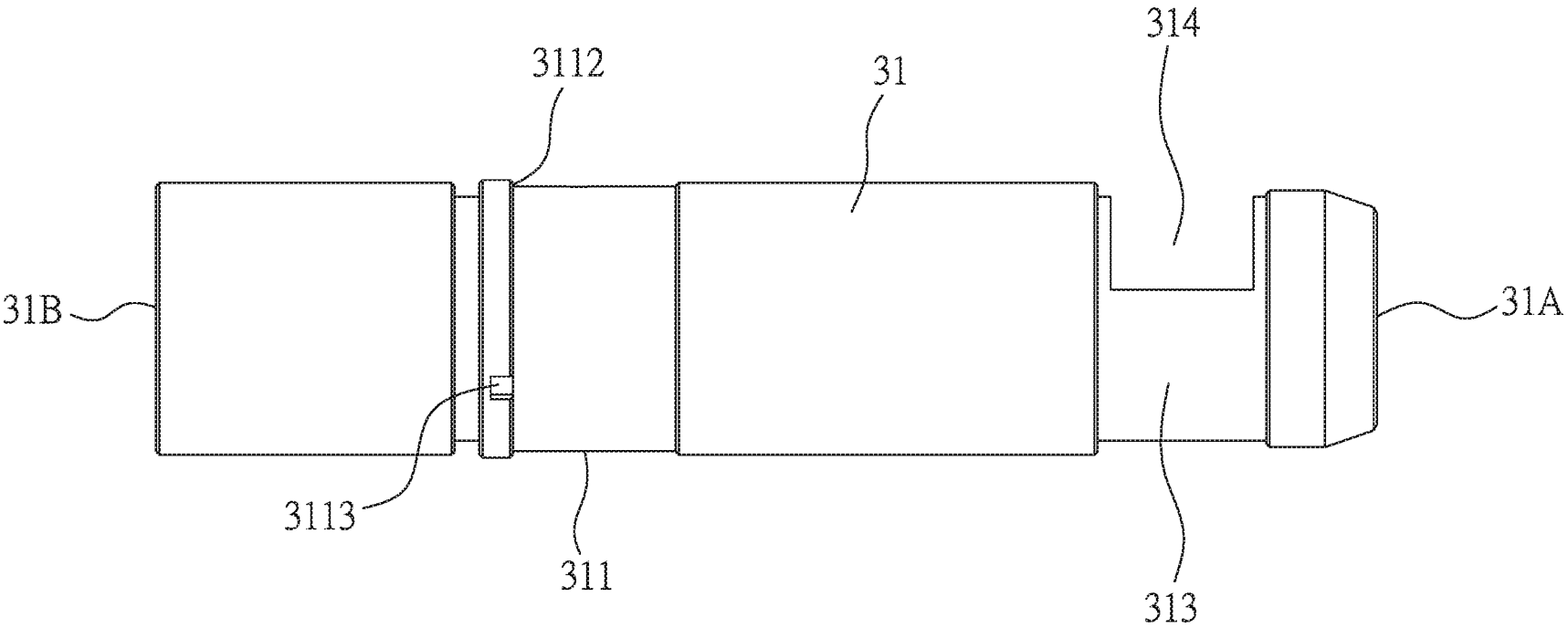
FIG. 6 is a side plan view showing the assembly of a part of the pneumatic tool structure according to the preferred embodiment of the present invention.

As shown in FIGS. 5 and 6, the drive unit 30 includes a body 31 having a first segment 31A and a second segment 31B, wherein a part of the second segment 31B of the body 31 is slidably fitted in the slidable sleeve 20, and the body 31 includes a recessed portion 311 formed around an outer wall thereof, wherein the recessed portion 311 has a fixing notch 3111 for rolling a steel ball 32 freely, and the steel ball 32 is clamped between the fixing notch 3111 and the elongated slot 211 of the slidable sleeve 20 so that the steel ball 32 matingly slides on the elongated slot 211 of the slidable sleeve 20 so as to limit the body 31 to linearly slide back and forth with respect to the slidable sleeve 20, such that the body 31 does not rotate. The recessed portion 311 has a defining fringe 3112 formed on an end thereof adjacent to the air intake head 10 and stopped by the shoulder 21 of the slidable sleeve 20, such that the body 31 is limited to slide forward in an extreme position. An air discharge conduit A1 is defined between the slidable sleeve 20 and the body 31, the defining fringe 3112 has at least one pressure relief groove 3113, the body 31 has a screw bolt 33 disposed in the second segment 31B thereof, and the screw bolt 33 has an air flow orifice 311 formed on a center thereof and configured to accommodate a bushing 332 and a pad 333, the bushing 332 of the air flow orifice 331 of the screw bolt 33 is slidably connected with an air guide tube 14, the pad 333 is configured to buffer a strike of the air guide tube 14. The first segment 31A of the body 31 has a second coupling orifice 312 and is connected with a transmission element 34, and the transmission element 34 has a driving rod 341 and a disk-shaped abutting portion 342 connecting with the driving rod 341, wherein the driving rod 341 of the transmission element 34 is received in the second coupling orifice 312 of the first segment 31A of the body 31, the body 31 has a connecting groove 313 defined adjacent to the first segment 31A, and the connecting groove 313 has a cutout 314 communicating with the second coupling orifice 312 and accommodating two protrusions 35, wherein the connecting groove 313 has a positioning ring 36 configured to fix the two protrusions 35 for limiting the transmission element 34. The body 31 accommodates a cylinder 37 in which a chamber 371 is defined and communicates with the second coupling orifice 312, and an air valve 38 is mounted between the chamber 371 and the screw bolt 33.

The piston 40 is slidably accommodated in the chamber 371 of the drive unit 30.

The operation element 50 is fixed on a front side of the body 31 and includes a tool socket 51 fitted with the outer wall of the body 31. The tool socket 51 accommodates a spring 52 and a holder 53 on which multiple rust removal needles 54 extend out of the tool socket 51, and the holder 53 contacts with the disk-shaped abutting portion 342 of the transmission element 34.

The resilient element 60 is elastic, received in the slidable sleeve 20, and defined between the air intake head 10 and the screw bolt 33, wherein the resilient element 60 includes a through hole 61 for receiving the air guide tube 14. In this embodiment, the resilient element 60 is arc elastic or is a spring.

Figure 7A:
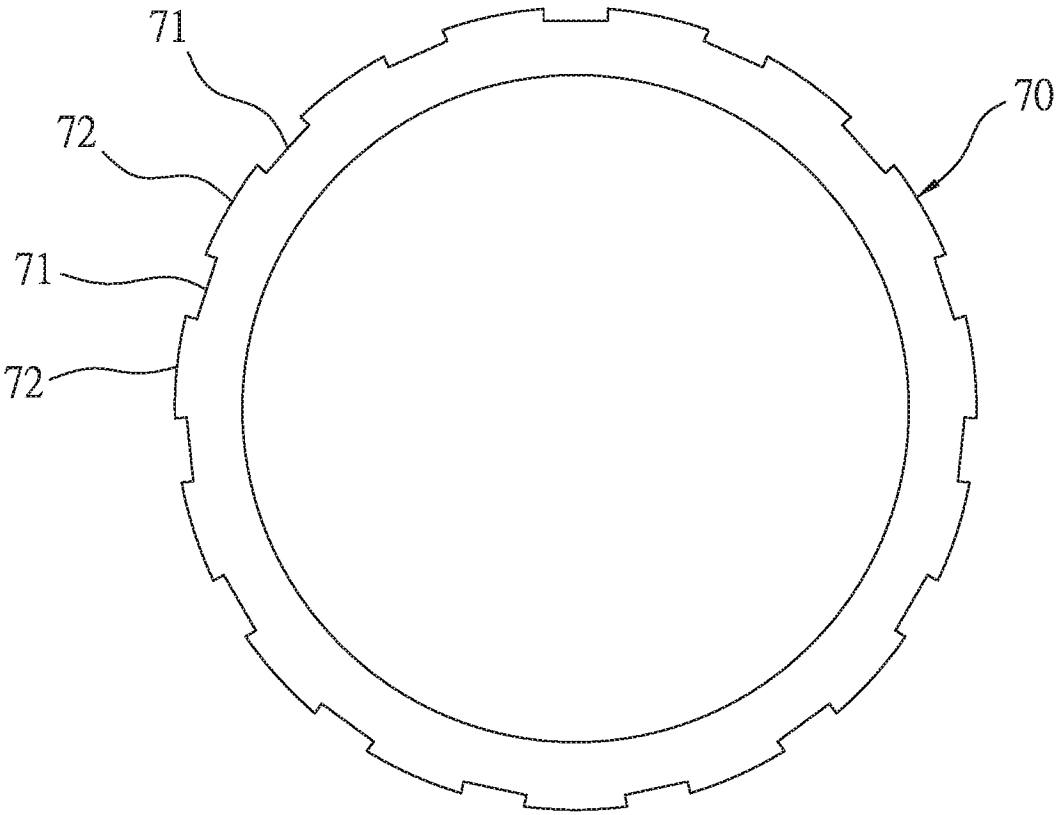
FIG. 7A is another side plan view showing the assembly of a part of the pneumatic tool structure according to the preferred embodiment of the present invention.
Figure 7B:
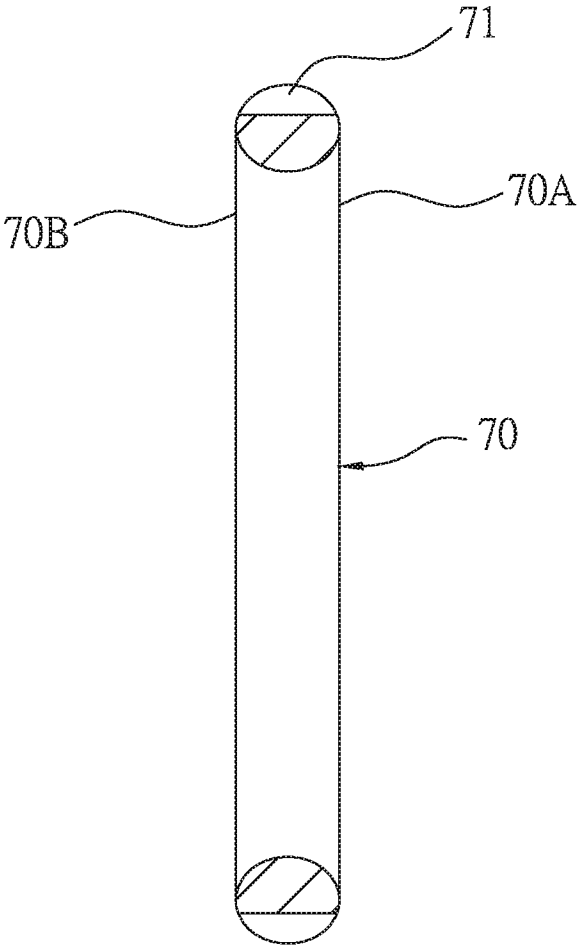
FIG. 7B is a cross sectional view showing the assembly of a part of the pneumatic tool structure according to the preferred embodiment of the present invention.

As illustrated in FIGS. 7A and 7B, the first isolation ring 70 is fitted on an outer wall of the screw bolt 33 and is located between the screw bolt 33 and the slidable sleeve 20, the first isolation ring 70 includes a first rim 70A, a second rim 70B opposite to the first rim 70A, multiple first discharging grooves 71 equidistantly formed on an outer wall of the first isolation ring 70, and multiple first contact portions 72, wherein a respective first contact portion 72 is formed between any two adjacent first discharging grooves 71, and the multiple first discharging grooves 71 are in communication with the first rim 70A and the second rim 70B.

Figure 8A:
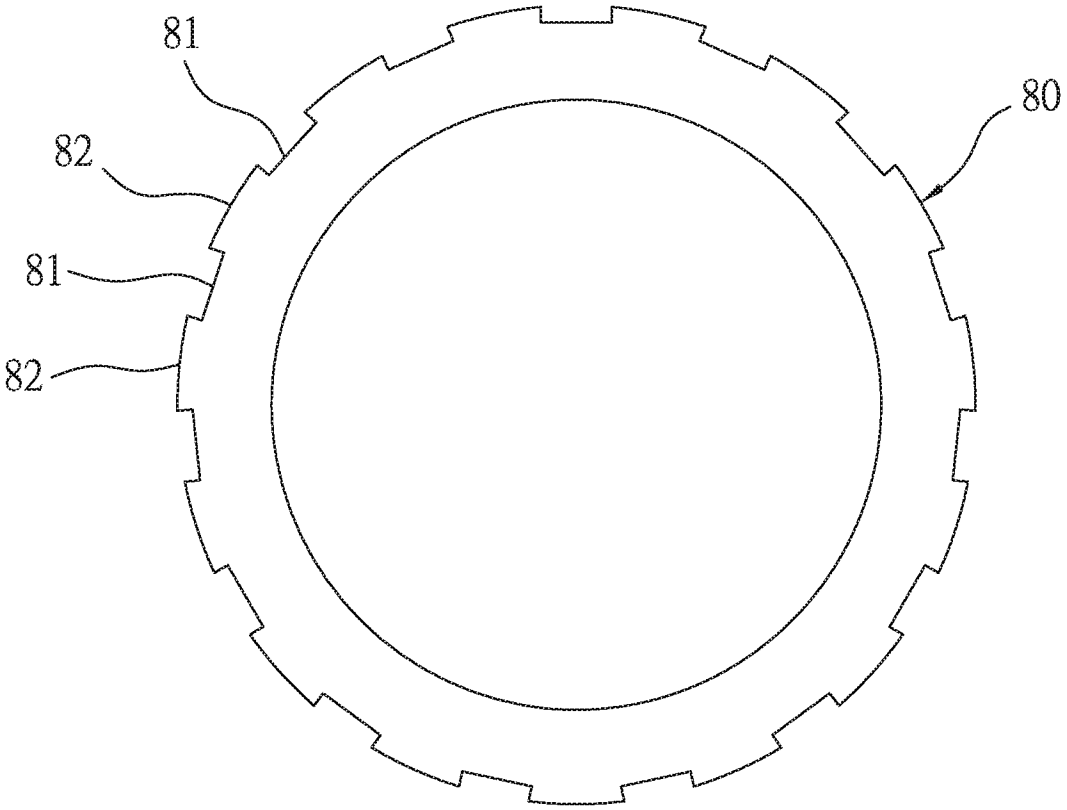
FIG. 8A is also another side plan view showing the assembly of a part of the pneumatic tool structure according to the preferred embodiment of the present invention.
Figure 8B:
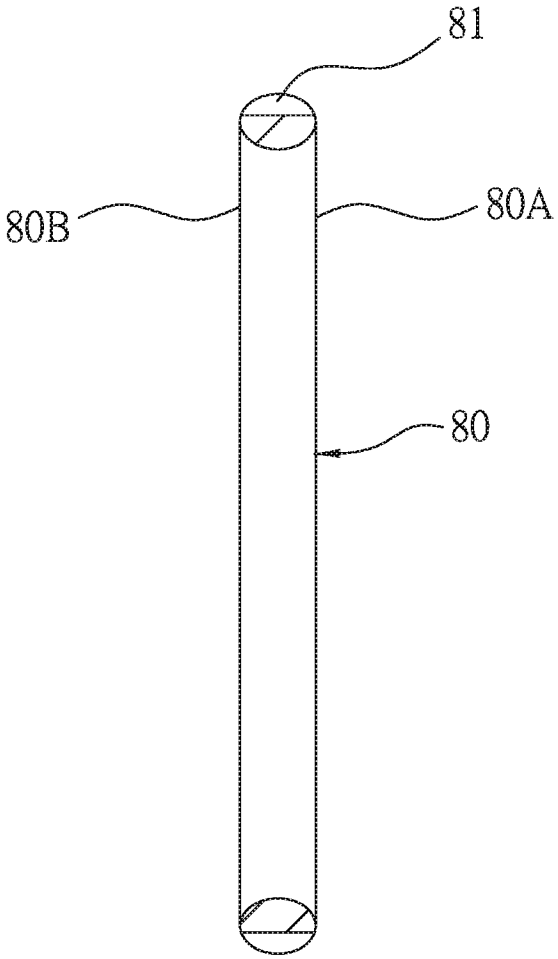
FIG. 8B is another cross sectional view showing the assembly of a part of the pneumatic tool structure according to the preferred embodiment of the present invention.

With reference to FIGS. 8A and 8B, the second isolation ring 80 is fitted on the outer wall of the body 31 and is located between the body 31 and the slidable sleeve 20, the second isolation ring 80 includes a third rim 80A, a fourth rim 80B opposite to the third rim 80A, multiple second discharging grooves 81 equidistantly formed on an outer wall of the second isolation ring 80, and multiple second contact portions 82, wherein a respective second contact portion 82 is formed between any two adjacent second discharging grooves 81, and the multiple second discharging grooves 81 are in communication with the third rim 80A and the fourth rim 80B.

Figure 9:
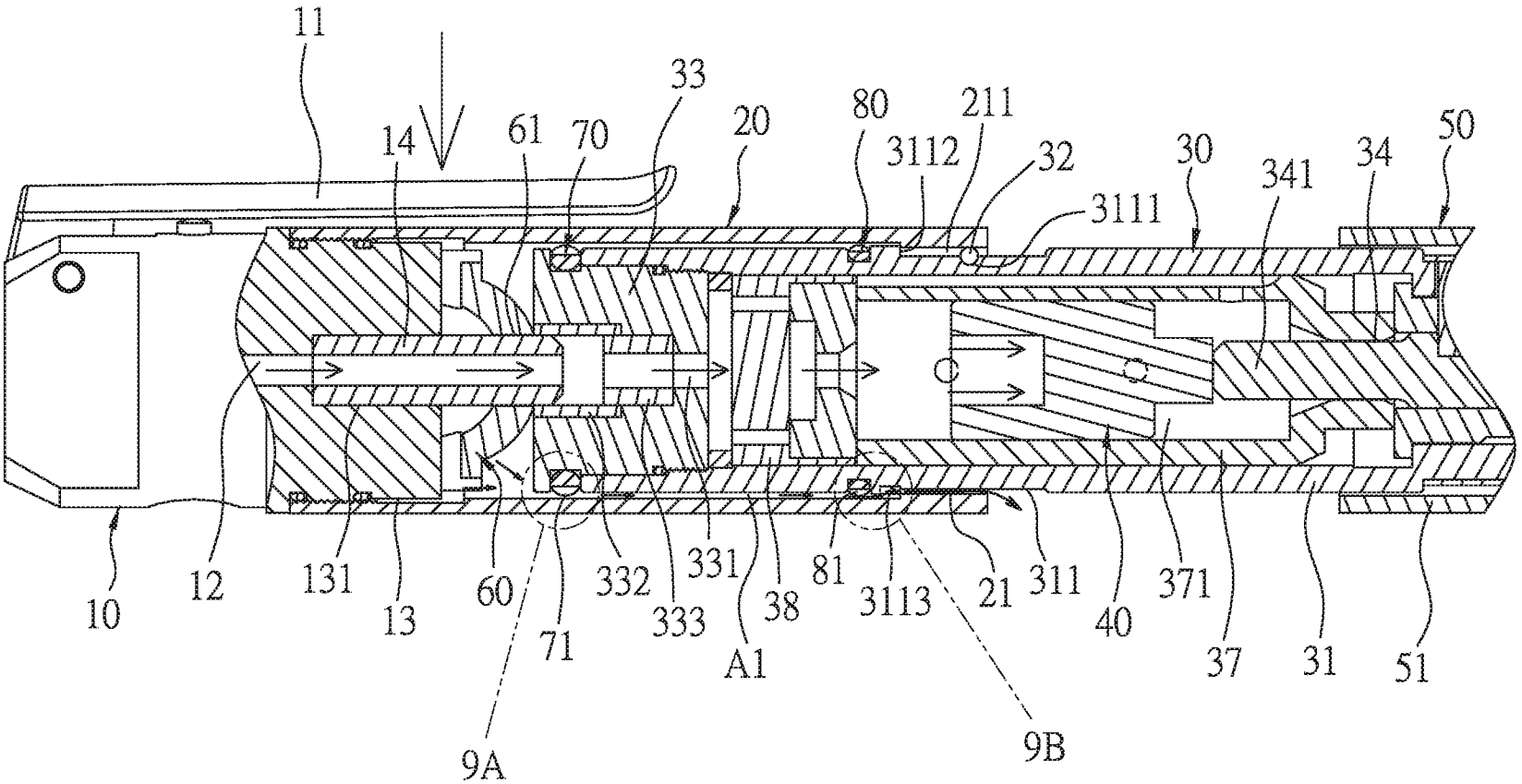
FIG. 9 is a cross sectional view showing the operation of the pneumatic tool structure according to the preferred embodiment of the present invention.
Figure 9A:
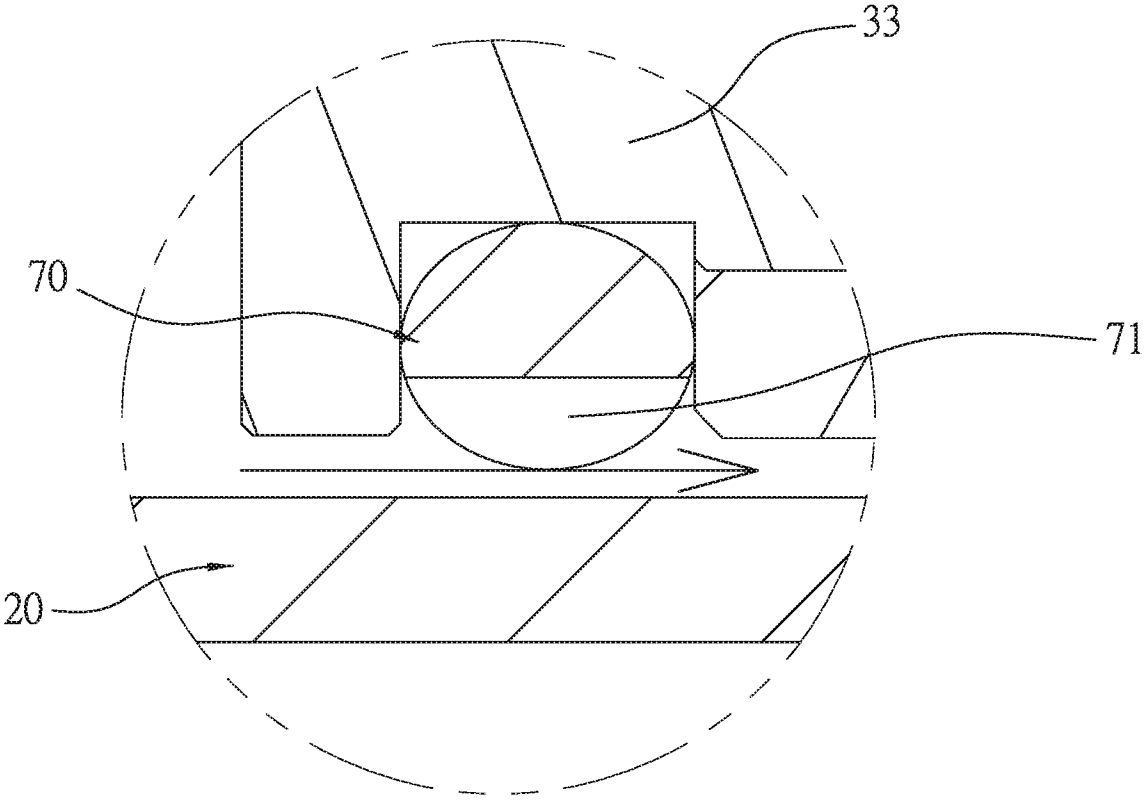
FIG. 9A is an amplified cross sectional view of a portion 9A of FIG. 9.
Figure 9B:
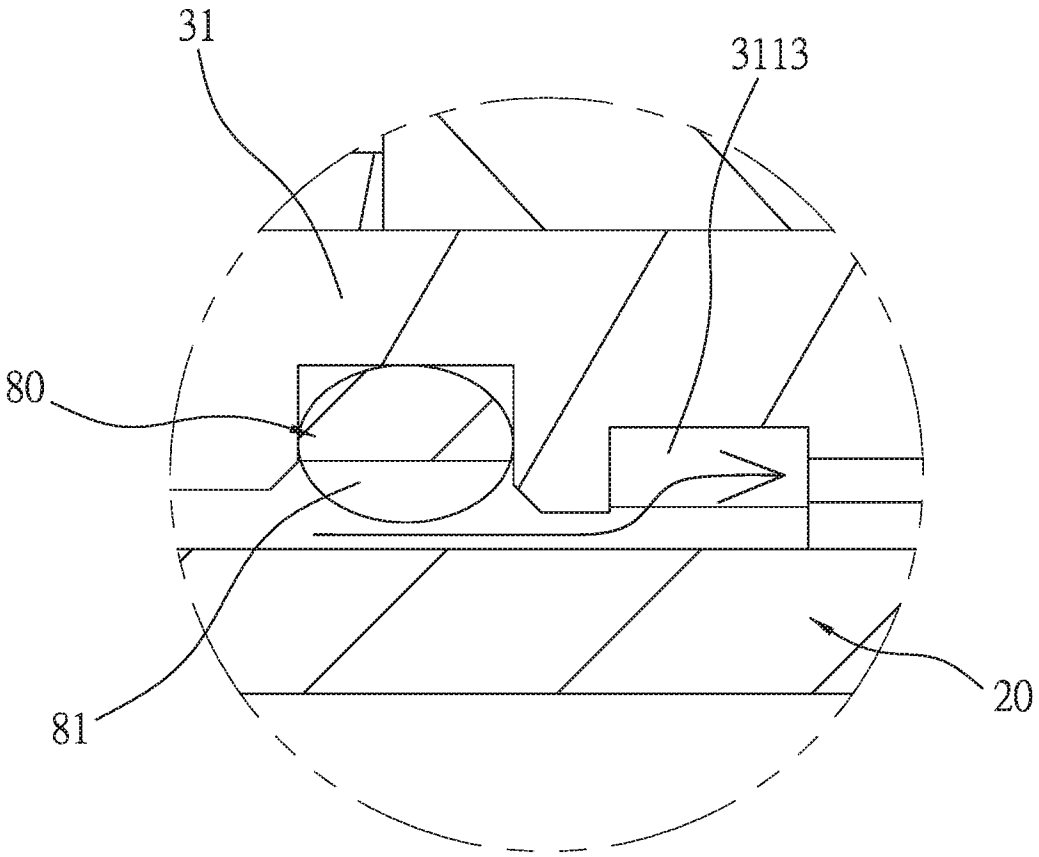
FIG. 9B is an amplified cross sectional view showing another portion 9B of FIG. 9.

In use, as shown in FIGS. 9-9B, the air intake head 10 and the slidable sleeve 20 are manually griped with a hand, and the tool socket 51 is held with the other hand, then the press lever 11 of the air intake head 10 is pressed to drive high-pressure airs to reach to the air valve 38 from the air channel 12 of the intake head 10 via the air guide tube 14 and to flow into the chamber 371 via the air valve 38 so that the high-pressure airs move to the first segment 31A of the body 31 to push the piston 40 to slidably strike the driving rod 341 of the transmission element 34, hence the drive unit 30 is actuated to slide to the operation element 50, and a part of the high-pressure airs discharges out of the at least one pressure relief groove 3113 via the multiple first discharging grooves 71 of the first isolation ring 70, the air discharge conduit A1, the multiple second discharging grooves 81 of the second isolation ring 80, thus releasing a pressure and eliminating vacuum.

Figure 10:
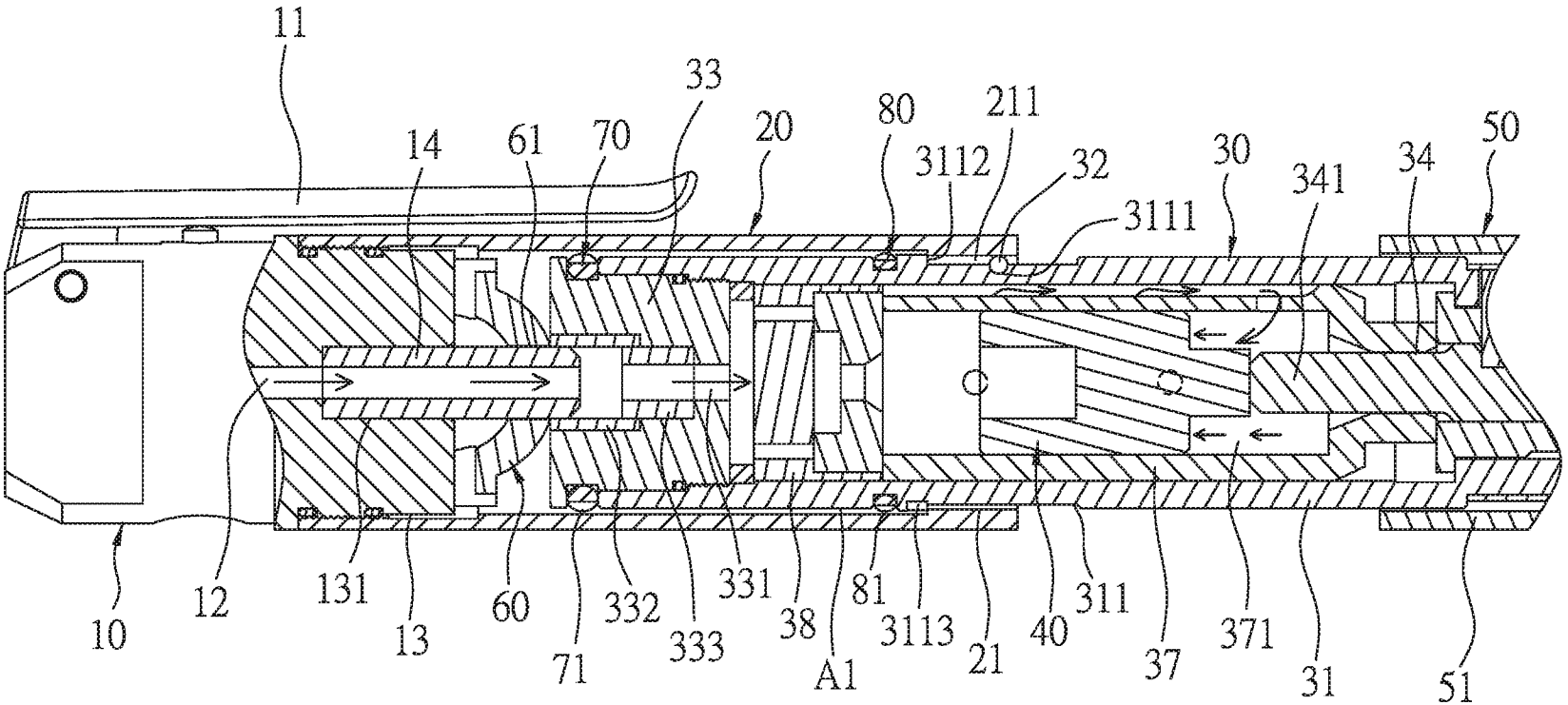
FIG. 10 is a cross sectional view showing the operation of the pneumatic tool structure according to the preferred embodiment of the present invention.
Figure 11:
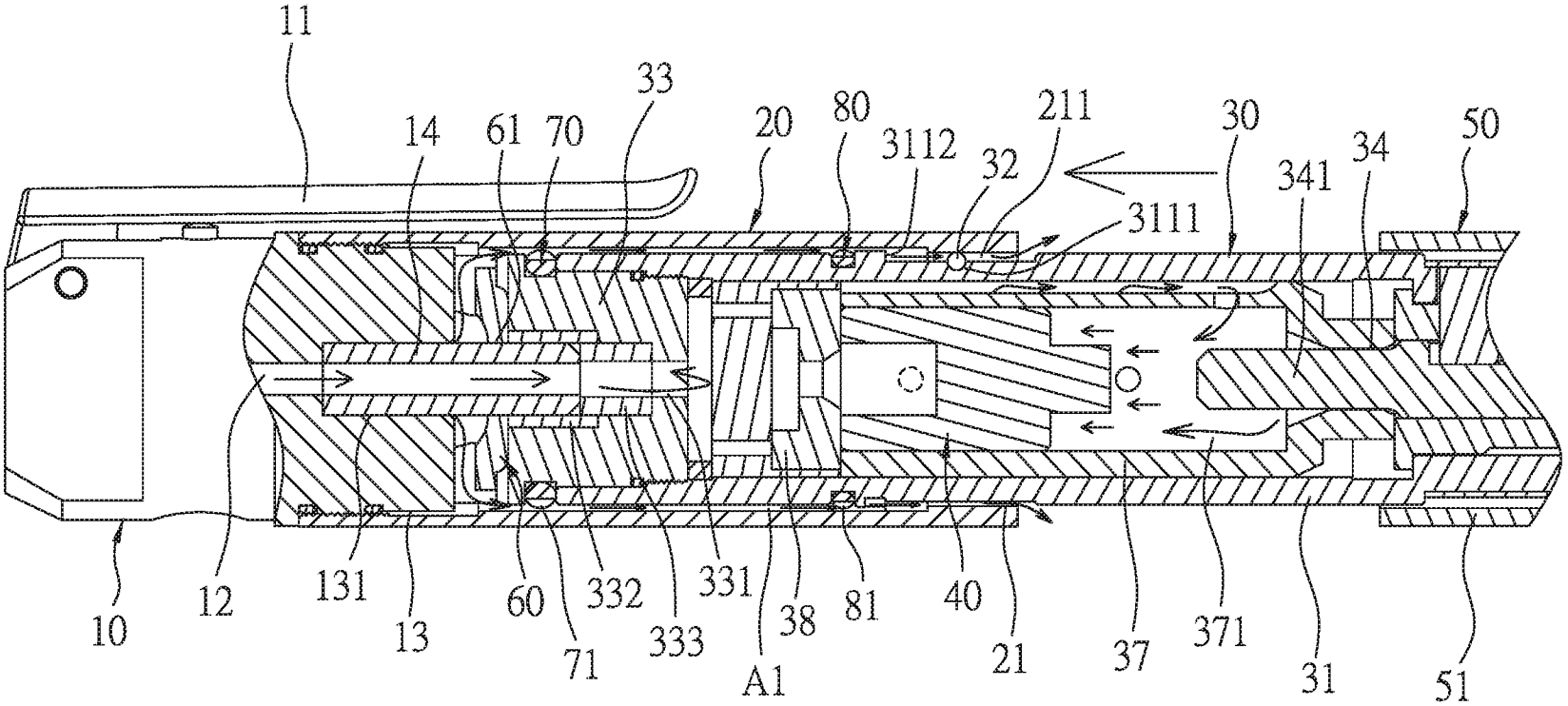
FIG. 11 is another cross sectional view showing the operation of the pneumatic tool structure according to the preferred embodiment of the present invention.
Figure 12:
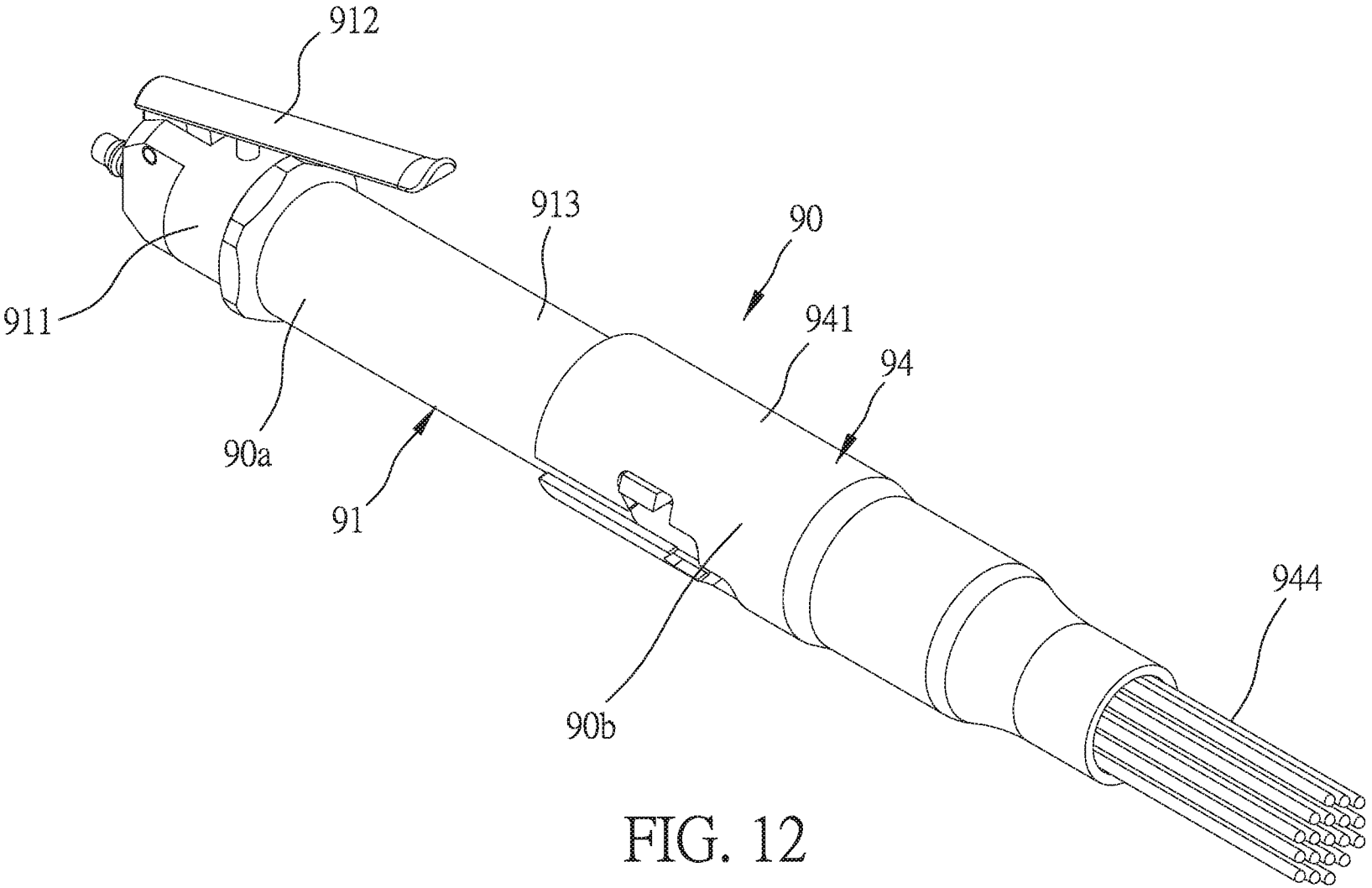
FIG. 12 PRIOR ART
FIG. 12 is a perspective view of a conventional pneumatic tool.
Figure 13:
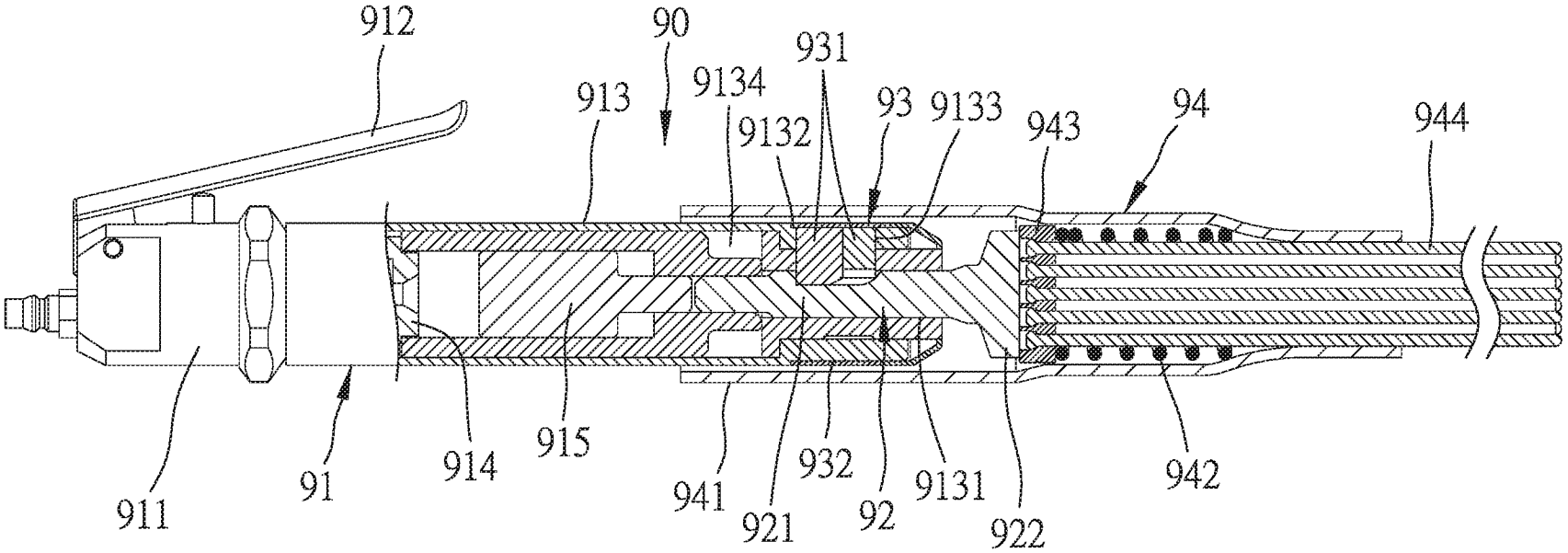
FIG. 13 PRIOR ART
FIG. 13 is a cross sectional view of the conventional pneumatic tool.

Referring to FIGS. 10 and 11, the high-pressure airs are controlled by the air valve 38 to push the piston 40 to slide to the second segment 31B of the body 31, such that the air valve 38 is struck by the piston 40 to actuate the drive unit 30 to slide to the press lever 11, and the part of the high-pressure airs discharge out of the at least one pressure relief groove 3113 via the multiple first discharging grooves 71 of the first isolation ring 70 (from the first rim 70A to the second rim 70B), the air discharge conduit A1, and the multiple second discharging grooves 81 of the second isolation ring 80 (from the third rim 80A to the fourth rim 80B), thus releasing the pressure and eliminating the vacuum. Thereafter, the screw bolt 33 presses the resilient element 60 to retract and forces the bushing 332 to slide along the air guide tube 14, and the pad 333 strikes the air guide tube 14. The resilient element 60 is configured to buffer the strike and to reduce a shock, and the multiple first contact portions 72 of the first isolation ring 70 and the multiple second contact portions 82 of the second isolation ring 80 contact with the inner wall of the slidable sleeve 20 to isolate the shock and to reduce a reaction force to user's hands, the piston 40 is pushed back and force repeatedly to strike the transmission element 34 and the air valve 38, and the disk-shaped abutting portion 342 of the transmission element 34 pushes the holder 53 of the operation element 50 to actuate the multiple rust removal needles 54 to remove rusts.

Thereby, the pneumatic tool structure of the present invention contains:

1. When the piston 40 slides backward to strike the air valve 38, the air guide tube 14 is configured to guide the body 31, the resilient element 60 is pressed to buffer the strike, and the first isolation ring 70 and the second isolation ring 80 isolate the shock, thus reducing vibration, the reaction force to the user's hands, soreness, and injury. Preferably, the pneumatic tool structure is operated effortlessly to protect user's wrists.

2. The air discharge conduit A1 is defined between the slidable sleeve 20 and the body 31, the multiple first discharging grooves 71 are equidistantly formed on the outer wall of the first isolation ring 70, and the multiple second discharging grooves 81 are equidistantly formed on the outer wall of the second isolation ring 80, the defining fringe 3112 of the body 31 has the at least one pressure relief groove 3113, thus releasing the pressure to operate the pneumatic tool structure normally.

While various embodiments in accordance with the present invention have been shown and described, it is clear to those skilled in the art that further embodiments may be made without departing from the scope of the present invention.

What is claimed is:

1. A pneumatic tool structure comprising:

an air intake head including a press lever, an air channel, and a connection portion formed on an end of the air intake head, the connection portion having a first coupling orifice defined on an edge of the connection portion and communicating with the air channel and configured to accommodate an end of an air guide tube;

a slidable sleeve, a first end of the slidable sleeve being screwed with the connection portion of the air intake head, and the slidable sleeve including a shoulder extending from an inner wall of a second end of the slidable sleeve;

a drive unit including a body having a first segment and a second segment, a part of the second segment of the body being slidably fitted in the slidable sleeve, and the body including a recessed portion formed around an outer wall of the body, the recessed portion having a defining fringe formed on an end of the recessed portion adjacent to the air intake head and stopped by the shoulder of the slidable sleeve, such that the body is limited to slide forward in an extreme position, wherein an air discharge conduit is defined between the slidable sleeve and the body, the defining fringe has at least one pressure relief groove, the body has a screw bolt disposed in the second segment of the body, and the screw bolt has an air flow orifice formed on a center thereof and configured to accommodate the air guide tube, the first segment of the body has a second coupling orifice, the body has a chamber communicating with the second coupling orifice, and an air valve is mounted between the chamber and the screw bolt;

a piston slidably accommodated in the chamber;

an operation element fixed on a front side of the body;

a resilient element being elastic, received in the slidable sleeve, and defined between the air intake head and the screw bolt, wherein the resilient element includes a through hole for receiving the air guide tube;

a first isolation ring fitted on an outer wall of the screw bolt and located between the screw bolt and the slidable sleeve, the first isolation ring includes a first rim, a second rim opposite to the first rim, multiple first discharging grooves equidistantly formed on an outer wall of the first isolation ring, and multiple first contact portions, wherein a respective first contact portion is formed between any two adjacent first discharging grooves, and the multiple first discharging grooves are in communication with the first rim and the second rim; and a second isolation ring fitted on the outer wall of the body and located between the body and the slidable sleeve, the second isolation ring including a third rim, a fourth rim opposite to the third rim, multiple second discharging grooves equidistantly formed on an outer wall of the second isolation ring, and multiple second contact portions, wherein a respective second contact portion is formed between any two adjacent second discharging grooves, and the multiple second discharging grooves are in communication with the third rim and the fourth rim.

2. The pneumatic tool structure as claimed in claim 1, wherein the shoulder has an elongated slot formed thereon, the recessed portion has a fixing notch for rolling a steel ball freely, and the steel ball is clamped between the fixing notch and the elongated slot of the slidable sleeve so that the steel ball matingly slides on the elongated slot of the slidable sleeve so as to limit the body to linearly slide back and forth with respect to the slidable sleeve, such that the body does not rotate.

3. The pneumatic tool structure as claimed in claim 1, wherein the air flow orifice of the screw bolt accommodates a bushing and a pad, the screw bolt is slidably connected with the air guide tube by using the bushing, the pad is configured to buffer a strike of the air guide tube.

4. The pneumatic tool structure as claimed in claim 1, wherein the first segment of the body is connected with a transmission element, and the transmission element has a driving rod and a disk-shaped abutting portion connecting with the driving rod, wherein the driving rod of the transmission element is received in the second coupling orifice of the first segment of the body, the body has a connecting groove defined adjacent to the first segment, and the connecting groove has a cutout communicating with the second coupling orifice and accommodating two protrusions, wherein the connecting groove has a positioning ring configured to fix the two protrusions for limiting the transmission element, the body accommodates a cylinder in which the chamber is defined.

5. The pneumatic tool structure as claimed in claim 1, wherein the operation element includes a tool socket fitted with the outer wall of the body, the tool socket accommodates a spring and a holder on which multiple rust removal needles extend out of the tool socket, and the holder contacts with a disk-shaped abutting portion of the transmission element.

* * * * *